United States Patent [19]

Goyette

[11] 4,256,301

[45] Mar. 17, 1981

[54] SOLO-OPERABLE BENCH PRESS DEVICE

[76] Inventor: Richard G. Goyette, 116 Dexter St., Cumberland, R.I. 02864

[21] Appl. No.: 70,304

[22] Filed: Aug. 27, 1979

[51] Int. Cl.[3] ..... A63B 21/06

[52] U.S. Cl. ..... 272/123; 272/144

[58] Field of Search ..... 272/123, 134, 118, 144, 272/121, 117, 116, 135, 136, 138

[56] References Cited

U.S. PATENT DOCUMENTS

| | | | |
|---|---|---|---|
| 3,834,694 | 9/1974 | Pridgen | 272/118 |
| 4,084,815 | 4/1978 | Flannery | 272/144 |
| 4,125,258 | 11/1978 | McArthur | 272/144 |
| 4,188,029 | 2/1980 | Brower | 272/145 |

*Primary Examiner*—Richard C. Pinkham
*Assistant Examiner*—T. Brown
*Attorney, Agent, or Firm*—Robert J. Doherty

[57] ABSTRACT

An exercise device of the bench press type which may be operated without the assistance of so-called "spotters". In its simplest form, the device includes a bench for supporting the weight lifting exerciser in a generally prone, face-up position. A tower for supporting the weighted bar is provided at the head end of the bench and a movable, i.e. slidable foot member, provided at the foot end of the bench. A strand normally under tension interconnects the weighted bar at its balance point to the foot member such that when the exerciser is supporting the weighted bar by his arms and shoulders, a portion of that weight may be relieved by pushing on the foot member. The device thus enables a weight lifting exerciser to perform bench press exercises safely and without the need of spotters. In addition, safety clamps are provided on the tower such that the weighted bar will not pivot about one of its support points when in an unbalanced state as when changing weights from opposite ends of the weighted bar.

8 Claims, 3 Drawing Figures

SOLO-OPERABLE BENCH PRESS DEVICE

BACKGROUND AND SUMMARY OF THE INVENTION

This invention relates to a weight lifting device and more particularly to a weight liftingdevice such that a weight lifter or other exerciser may safely perform bench press type exercises without the need of spotters at opposite ends of the weighted bar. Bench press exercises are a well-known exercise for increasing one's strength and particularly of the upper body. They are conducted by the exerciser assuming a generally prone position upon a padded longitudinally extending bench or other similar support. A weighted bar normally having replaceable weights disposed on opposite ends thereof is then transversely disposed across the exerciser's chest whereupon he or she hand grasps the weighted bar at conveniently spaced positions and proceeds to repeatedly elevate the weighted bar above his or her chest.

One of the more beneficial aspects of performing such exercise in the above manner is that it enables the person when lifting the absolute maximum weight that he is capable of, to make impressive strength gains. However, attempting to lift such maximum weights, can also lead to the person's inability to support the weighted bar either on a first or subsequent attempt to elevate the bar and thus can create a situation where the heavily weighted bar in effect can crash down upon the person and can cause serious injury. Accordingly, such exercises at least when the weight lifter is attempting maximum lifts are normally performed with the assistance of two spotters which are positioned on opposite ends of the weighted bar such that they are immediately available to take up or relieve the weight lifter from that portion of the weight which he is unable to lift. The presence and availability of the so-called spotters is not always convenient especially to amateur weight lifters and even if available, requires oral or other recognizable communications such that the efforts of the weight lifter and spotters are coordinated.

It is known to utilize a tower or other structure on which the weighted bar is supported at spaced lateral points at the head end of the bench. This to some extent relieves the necessity of spotters at least to initially position the bar such that it may be conveniently grasped by the weight lifter. Such structures do not however relieve the necessity of spotters for safety purposes especially when the lifter is attempting maximum lifts. Also, inasmuch as weighted bars of this type normally use replaceable disc-like weights at opposite ends thereof in building up the desired total weight, there is a likelihood that a resultant temporary imbalance between one end of the weighted bar and the other during weight changes will result in a tilt or pivot movement of the bar about one of its supports that may result in the weighted bar falling or sliding from its support. For this additional reason, it is of often advisable for such bench press exercises to be conducted with the assistance of others whether or not such other persons assume the above-described position of spotters.

It is accordingly an object of the present invention to provide an exercise device which may be used by the weight lifting exerciser alone and yet still enable such exerciser to attempt maximum lifts without the need of spotters.

A further object of the present invention is the provision of a weight lifting device of the aforementioned type in which replaceable weights may be unaidedly removed or added to opposite ends of the weighted bar without causing undesirable pivoting of the bar about its support.

These and other objects of the present invention are accomplished by a device including a bench for the general prone upright support of the exerciser. One end of the bench includes an elevated tower and the other end is provided with a longitudinally movable member on which the person's feet are adapted to rest. The weighted bar which is supported by the tower in a non-use or a non-exercise position is connected at a balanced point thereof by means which is also interconnected to the foot member such that movement of the foot member towards the other end of the bench will relieve a portion of the weight of the weighted bar from the exerciser's arms and shoulders. In addition, a tower is provided with safety clamps which are adapted to move to a position above the bar so as to engage the bar in such a manner that it cannot pivot from its rest or non-exercise position as when replaceable weights provided at opposite ends thereof cause a temporary imbalance thereof.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
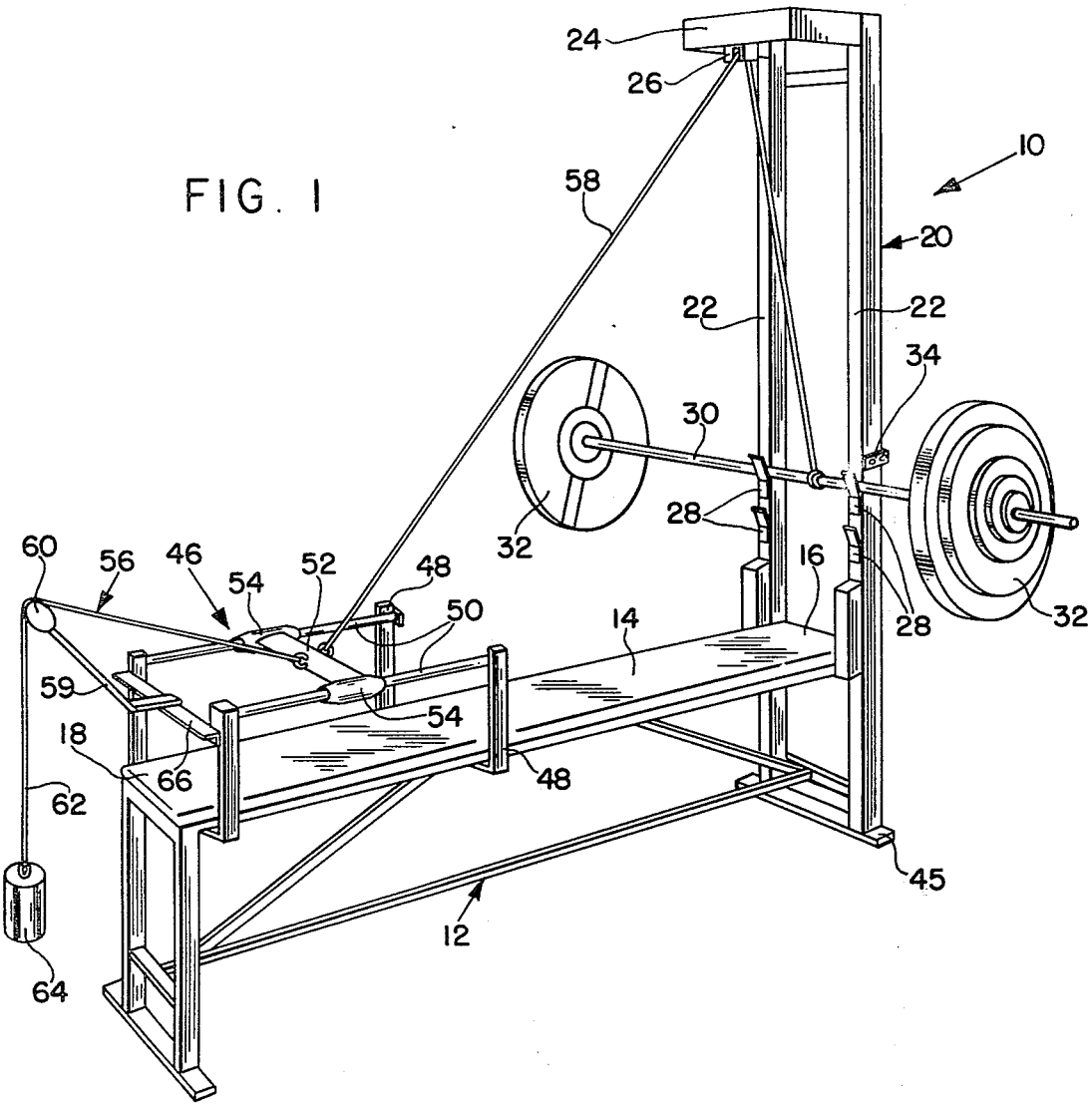
FIG. 1 is a perspective view showing the device of the present invention.

Turning now to the drawing and particularly FIG. 1 thereof, the bench press device 10 of the present invention is shown. Such device 10 includes an overall frame 12 which supports a generally longitudinally oriented bench 14 in a generally horizontal position. The bench 14 includes a head end 16 and foot end 18. The bench 14 is usually provided with suitable padding and a tough non-rip upholstery such that it may comfortably support a weight lifter or other exerciser in a generally prone, face-up position, that is, that the exerciser's head at the head end 16 and resting with his or her back supported by the bench.

A tower 20 including a pair of laterally spaced upright posts 22 is positioned at the head end 16 of the bench 14 and is preferably connected thereto and accordingly forms part of the overall frame 12. The upper end of the tower 20 includes a cross bar 24 which interconnects the spaced upright posts 22. A wheeled pulley 26 or other directional change device is supported from the underside of the cross bar 24 for a purpose which will be hereinafter more fully explained. The inside portions of the upright posts 22, that is, those portions disposed proximate or facing the bench 14 are provided with a plurality of vertically spaced rack or hanger elements 28 welded or otherwise suitably affixed thereto and having an upper portion 29 which outwardly extends from the post so as to form a generally V-shaped support for receipt of the elongated and laterally extending bar 30 between the bar is in turn adapted to be weighted at opposite ends thereof by replaceable disc-like weights 32 in a known manner and accordingly the total weight of the bar 30 may be varied dependent on the desired weight to be elevated by the exerciser in the known manner. Inasmuch as the rack elements 28 are laterally spaced from each other, pairs thereof (equal height disposed elements from the two posts 22) cooperatively form a cradle for receipt of the weighted bar 30 which is effective in maintaining the bar in a desired non-exercise position so long as the opposite ends of the bar generally equally loaded, that is, provided with an equal total of replaceable weights 32.

Figure 2:
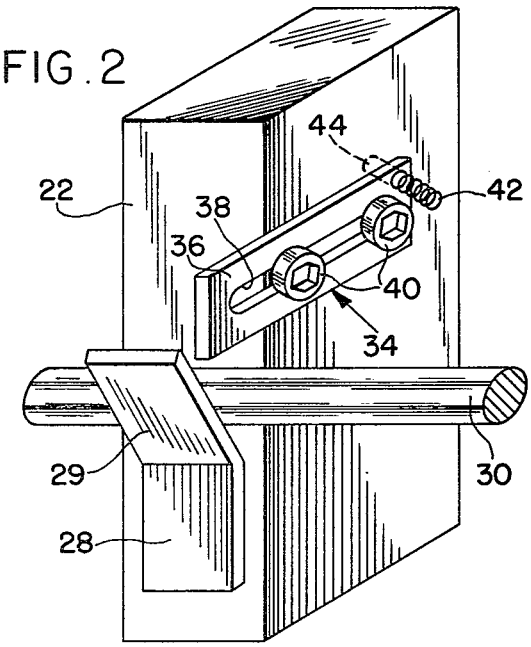
FIG. 2 is an enlarged view showing one position of the safety clamp device of the present invention.
Figure 3:
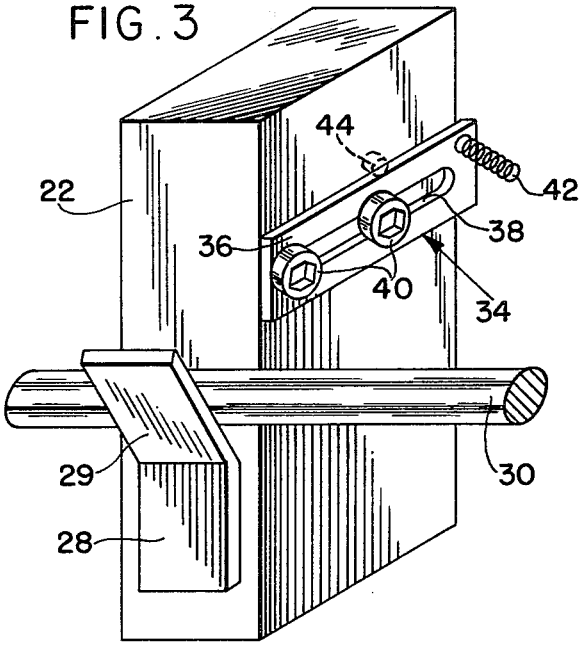
FIG. 3 is an additional view of the safety clamp mechanism.

In order that the weighted bar 30 will not pivot about one of the rack elements 28 of the supporting pair thereof when an unbalanced weight is present at one end of the bar 30 as when additional weights are being placed on the bar or when weights are being removed from the bar, each of the posts 22 is provided with a safety clamp assembly 34. Such assembly includes elongated clamping element 36 having elongated slot 38 formed therein. A pair of headed bolts 40 are adapted to pass through the slot 38 and threadably connect to the post 22 so as to attach the element 36 thereto for a slidable relationship between the positions shown in FIGS. 2 and 3. Accordingly, it may be seen that when the elements 36 are disposed in a forward position, they are adapted to extend over the weighted bar 30 such that any tendency for the bar to pivot about either one of the rack elements 28 will be prevented. Each element 36 is also provided with a spring detent 42 adapted to be positioned in an opening 44 provided in the sidewall of the posts 22 when the element 36 is disposed in its forward bar locking position as shown in FIG. 2. The above described safety clamp mechanism is normally associated with each of the rack element 28 and accordingly enables the exerciser to change the weights 32 at opposite ends of the bar 30 without causing the bar to undesirably pivot about one of the rack elements forming the support pair thereof. Accordingly, the need for assistance during the changing of weights is eliminated. In this regard, the posts 22 are preferably provided with means for anchoring them to the floor such as the outwardly extending feet 45 shown and which may be bolted to the supporting floor if desired.

The foot end 18 of the bench 14 is provided with a secondary frame assembly 46 including a pair of longitudinally spaced upright posts 48 provided on each side of the bench 14. A longitudinally extending rod 50 is positioned between the posts 48. Such rods 50 are accordingly laterally spaced from each other and positioned above the upper surface of the bench 14. A foot member or bar 52 is adapted to extend laterally between the rods 50 and is provided at opposite ends with a sleeve 54 which is adapted to ride back and forth along the rods 50. In addition, a strand 58 formed from suitable material such as steel cable, rope and the like is connected at one end thereof to the foot member 52 generally centrally thereof and at the other end to the weighted bar 30 preferably at its central balance point. The intermediate run of the strand 58 extends through the direction changing pulley 26. The strand 58 is of a finite length such that movement of the foot element 52 towards the foot end of the bench will cause the strand 58 to elevate the weighted bar 30 and on the other hand movement of the foot member 52 towards the head end of the bench will lower the weighted bar.

The bar 30 may be entirely supported either by the tower 20 in a non-use position as by the aforementioned cradle support by a pair of rack elements 28 or by the exerciser's arms and shoulders in the exercise or use position. A counter weight or tension assembly 56 is provided at the foot end 18 of the bench and includes an outwardly rearwardly extending boom 59 having a directional changing pulley 60 at the terminal end thereof. A secondary strand 62 is adapted to extend over the pulley 60 and is attached at one end thereof to the foot member 52 and is provided with a counter weight 64 at the opposite end. The assembly 56 may alternately take the form of a spring powered reel (not shown) disposed between the foot member 52 and the cross member 66 which in turn extends between the rear most position and upright post 48 and from which the rearwardly extending boom 59 is attached. Spring reels of this type are known and they themselves form no part of the present invention except to the extent of performing the above-indicated tensioning function.

It accordingly may be seen that the weight lifter may position him or herself upon the bench 14 with his feet supported upon the foot member 52 with his legs straddling the strand 58. From this position, maximum lifts may be attempted without the assistance of conventional spotters since at any time that the lifter feels that he will not be able to support the full weight of the weighted bar 30, a portion of this weight may be relieved by pushing with his feet against the foot member 52, thus causing an upward movement of that portion of the strand 58 connected to the bar 30 so as to relieve a portion of the weight thereof from his arms and shoulders. Thus, the weight lifter may comfortably attempt to lift maximum weights knowing that even if such weights may not be fully supported by his arms and shoulders, that the more than adequate force of his legs is available to relieve at least a portion of the full weight. Accordingly, maximum weights may be attempted in a manner without the danger of having the bar collapse upon the exerciser.

When the foot member 52 is in its most forward position proximate the head end 16 of the bench, the forward ends of the sleeves 54 abut against the posts 48. In this position, the length of the strand 58 is such that it will support the weighted bar 30 a distance above the top surface of the bench 14 corresponding to the thickness of the lifter's chest. Obviously, the length of the strand 58 may be adjusted for various size lifters so as to provide the maximum amount of protection from this additional safety feature.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An exercise device of the bench press type wherein a person assumes a generally prone, face-up, back supported position while lifting a weighted bar to an elevated position comprising, a generally longitudinally oriented bench support for said person, an elevated tower positioned at one end of said bench, said tower positioned at said one end and adapted to support a weighted bar in a non-use position, a foot member engageable by the person's feet positioned proximate the other end of said bench and supported for at least limited back and forth longitudinal movement with respect to said bench, and means interconnecting said member and said weighted bar such that force exerted on said member by said person's feet so as to force said member towards said other end independently tends to lift said weighted bar so as to relieve a portion of the weight of said weighted bar from the arms and shoulders of said person when in a use position.

2. The device of claim 1, said interconnecting means being a strand connected at one end thereof to said weighted bar generally at the central balance point thereof and to said foot member at the other end thereof, an intermediate portion of said strand passing over a direction changing element in turn mounted in said tower above said weighted bar.

3. The device of claim 2, including means for limiting the forward movement of said foot member towards said one end of said bench, said strand being of a finite length such that the weighted bar may be supported in a use position spaced above said bench when said foot member is stopped in its most forward position.

4. The device of claim 2, said foot member being a bar mounted for slidable movement along a pair of laterally spaced parallel rods disposed on opposite sides of said bench at said other end.

5. The device of claims 2 or 4, including means for urging said foot member towards said bench other end so as to maintain tension on said strand.

6. The device of claim 1, said weighted bar adapted to receive replaceable weights at opposite ends thereof so that the total weight of said weighted bar may be varied, said tower including a pair of upright posts disposed on opposite sides of said bench, each of said posts having a rack element for receiving a portion of said weighted bar, each post further including means movable to a position such that said weighted bar is engaged therebetween to prevent the tilting or pivot of said weighted bar about one of said rack elements when the replaceable weights thereon present an unbalanced bar and to a position removed from said weighted bar such that the bar may be supported by the person in its use position.

7. The device of claim 6, said bench one end being connected to said tower and means for fixing said tower to a floor so as to prevent rocking of said posts when shifting weights on said weighted bar.

8. The device of claim 6, said means for preventing the pivot of said bar being a clamp slidably supported above said bar on each said post.

* * * * *